US011071676B2

(12) United States Patent
Fellingham et al.

(10) Patent No.: US 11,071,676 B2
(45) Date of Patent: Jul. 27, 2021

(54) COLLAPSIBLE WHEELED WALKER WITH STABILITY ENHANCING BRACKET APPARATUS AND METHOD

(71) Applicant: ProtoStar, Inc., San Diego, CA (US)

(72) Inventors: Peter James Fellingham, San Diego, CA (US); Craig Timothy Shugert, Rancho Santa Fe, CA (US); Yichuan Pan, San Diego, CA (US); Haibin Wu, Xiamen (CN)

(73) Assignee: ProtoStar, Inc., San Diego, CA (US)

( * ) Notice: Subject to any disclaimer, the term of this patent is extended or adjusted under 35 U.S.C. 154(b) by 0 days.

(21) Appl. No.: 16/836,728

(22) Filed: Mar. 31, 2020

(65) Prior Publication Data

US 2020/0315901 A1 Oct. 8, 2020

Related U.S. Application Data

(60) Provisional application No. 62/830,183, filed on Apr. 5, 2019.

(51) Int. Cl.
*A61H 3/04* (2006.01)

(52) U.S. Cl.
CPC ..... *A61H 3/04* (2013.01); *A61H 2003/046* (2013.01); *A61H 2201/1635* (2013.01)

(58) Field of Classification Search
CPC ..... A61H 3/04; A61H 2003/046; A61H 2201/1635
See application file for complete search history.

(56) References Cited

U.S. PATENT DOCUMENTS

| | | | |
|---|---|---|---|
| 2,046,105 | A | 6/1936 | Bowen |
| 3,394,933 | A | 7/1968 | Benoit |

(Continued)

FOREIGN PATENT DOCUMENTS

| | | |
|---|---|---|
| CN | 303106952 | 2/2015 |
| EP | 3066982 | 9/2016 |
| EP | 3095431 | 11/2016 |
| GB | 1342397 | 1/1974 |

(Continued)

OTHER PUBLICATIONS

Thomas, Shane, "International Search Report and Written Opinion of the International Searching Authority," PCT/US2020/026252, dated Jul. 15, 2020, 7 pages, ISA/US, Alexandria, Virginia.

(Continued)

*Primary Examiner* — Erez Gurari
(74) *Attorney, Agent, or Firm* — Stetina Brunda Garred and Brucker

(57) ABSTRACT

The disclosure demonstrates a collapsible wheeled walker having two side frames supported above a walking surface with attached wheel assemblies. The side frames are interconnected by an X-folder apparatus. The X-folder apparatus has first and second elongate elements rotatably coupled to each other with the bottom ends of the elements rotatably attached to the bottoms of the side frames, and the top ends of the elements having perpendicular support elements that in the deployed open position, engage support brackets formed on the inner sides of the side frames. The support brackets have protrusions extending from bracket support surfaces to engage complementary apertures formed in the perpendicular support elements to provide stability to the wheeled walker.

20 Claims, 14 Drawing Sheets

(56) References Cited

U.S. PATENT DOCUMENTS 3,625,237 A 12/1971 Wertz
4,018,440 A 4/1977 Deutsch
4,510,956 A 8/1985 King
4,907,794 A 3/1990 Rose
5,020,560 A 6/1991 Turbeville
5,137,102 A 8/1992 Houston
5,224,562 A 7/1993 Reed
5,411,044 A 5/1995 Andolfi
5,605,169 A 2/1997 Light
5,626,094 A 5/1997 Jeffrey et al.
5,636,651 A 6/1997 Einbinder
5,657,783 A 8/1997 Sisko et al.
5,676,388 A 10/1997 Bertani
5,702,326 A 12/1997 Renteria
5,741,020 A 4/1998 Harroun
5,803,103 A 9/1998 Haruyama
6,048,292 A 4/2000 Gasquez
6,099,002 A * 8/2000 Uchiyama ..... A61H 3/04 135/67
6,494,469 B1 12/2002 Hara et al.
6,708,705 B2 3/2004 Nasco, Sr.
6,733,018 B2 5/2004 Razon
6,886,575 B2 5/2005 Diamond
6,921,101 B1 7/2005 Lauren et al.
6,974,142 B1 12/2005 Shikinami et al.
6,983,813 B1 1/2006 Wright
7,001,313 B1 2/2006 Crnkovich
7,052,030 B2 5/2006 Serhan
7,108,004 B2 9/2006 Cowie
7,111,856 B1 9/2006 Graham
7,275,554 B2 10/2007 Mulholland
D561,065 S 2/2008 Kindberg et al.
7,377,285 B2 5/2008 Karasin et al.
7,422,025 B1 9/2008 Waldstreicher et al.
7,494,138 B2 2/2009 Graham
7,497,449 B2 3/2009 Logger
7,500,680 B2 3/2009 Dayton et al.
7,540,342 B1 6/2009 Ein
7,559,560 B2 7/2009 Li et al.
7,568,712 B2 8/2009 Kovachi et al.
7,669,863 B2 5/2010 Steiner et al.
7,708,120 B2 5/2010 Einbinder
7,866,677 B1 1/2011 Rothstein et al.
7,992,584 B1 8/2011 Birnbaum
8,002,295 B1 8/2011 Clark
8,100,415 B2 1/2012 Kindberg et al.
D654,833 S 2/2012 Pettersson et al.
8,151,812 B2 4/2012 Razon
8,166,987 B2 5/2012 Weaver
8,215,652 B2 7/2012 Dashew et al.
8,234,009 B2 7/2012 Kitahama
8,251,079 B1 8/2012 Lutz et al.
8,468,622 B2 6/2013 Purwar et al.
8,540,256 B1 9/2013 Simpson
8,562,007 B2 10/2013 Menichini
8,573,612 B1 11/2013 Fulk et al.
8,678,425 B2 3/2014 Schaaper et al.
8,740,242 B2 6/2014 Slomp
8,770,212 B2 7/2014 Alghazi
8,783,700 B2 7/2014 Li
8,794,252 B2 8/2014 Alghazi
8,840,124 B2 9/2014 Serhan et al.
8,936,033 B2 1/2015 Velarde
8,983,732 B2 3/2015 Lisseman et al.
8,998,223 B2 4/2015 Chang
9,016,297 B2 4/2015 Salomon
D739,314 S 9/2015 Wang et al.
9,149,408 B2 10/2015 Karlovich
9,173,802 B2 11/2015 Willis
9,180,066 B2 11/2015 Izard et al.
9,186,992 B2 11/2015 Katayama
9,221,433 B2 12/2015 Dunlap
9,226,868 B2 1/2016 Andersen
9,289,347 B2 3/2016 Powell
D754,034 S 4/2016 Wang et al.
D754,568 S 4/2016 Wang et al.
9,314,395 B1 4/2016 Vanausdall
9,339,432 B2 5/2016 Liu et al.
9,351,898 B2 5/2016 Triolo et al.
9,375,097 B2 6/2016 Stango
9,381,132 B2 7/2016 Chen
D766,139 S * 9/2016 Chen ..... D12/130
9,486,385 B1 11/2016 Terrill
9,566,207 B1 2/2017 Ratliff
9,585,807 B2 3/2017 Fellingham et al.
9,646,514 B2 5/2017 Rizzo
9,662,264 B2 5/2017 Jacobs
9,687,411 B2 6/2017 Chen
9,744,094 B2 8/2017 Liu et al.
9,763,849 B2 9/2017 Paterson et al.
9,795,825 B2 10/2017 Johnson
9,839,571 B2 12/2017 Pan
9,849,057 B1 * 12/2017 Janeczek ..... B60T 7/08
D807,793 S 1/2018 Paterson et al.
9,877,889 B2 1/2018 Chen
9,907,723 B2 3/2018 Bisceglia et al.
9,968,509 B2 5/2018 Andersen
9,974,708 B1 5/2018 Janeczek et al.
D819,503 S 6/2018 Huang
10,013,756 B2 7/2018 Kimmel et al.
D836,499 S 12/2018 Delatorre et al.
D837,697 S 1/2019 Luo
D845,841 S 4/2019 No-Young
10,307,321 B2 6/2019 Pan et al.
D865,575 S * 11/2019 Lin ..... D12/130
D869,347 S 12/2019 Huang
10,543,144 B2 1/2020 Johnson et al.
D874,351 S 2/2020 Fellingham et al.
10,555,866 B2 2/2020 Pan et al.
10,583,065 B1 3/2020 Mejia
10,617,592 B2 4/2020 Fellingham et al.
D903,538 S * 12/2020 Lin ..... D12/130
10,973,730 B2 4/2021 Fellingham et al.
2001/0048206 A1 12/2001 Niu et al.
2003/0137119 A1 7/2003 Razon
2005/0156395 A1 7/2005 Bohn
2005/0211285 A1 * 9/2005 Cowie ..... A45B 7/00 135/74
2007/0170699 A1 * 7/2007 Li ..... A61H 3/04 280/642
2007/0204429 A1 9/2007 Cheng
2007/0233403 A1 10/2007 Alwan et al.
2008/0079230 A1 4/2008 Graham
2009/0224499 A1 9/2009 Dashew et al.
2012/0136666 A1 5/2012 Corpier et al.
2012/0256384 A1 10/2012 Schaaper et al.
2012/0318311 A1 12/2012 Alghazi
2013/0082454 A1 4/2013 Slomp
2013/0319488 A1 12/2013 Chiu
2014/0116482 A1 5/2014 Simpson
2014/0125037 A1 5/2014 Andersen
2014/0265256 A1 9/2014 Rothstein et al.
2014/0333040 A1 11/2014 Liu
2015/0051519 A1 2/2015 Morbi et al.
2015/0066242 A1 3/2015 Tanaka
2015/0066325 A1 3/2015 Tanaka
2015/0066328 A1 3/2015 Nakada
2015/0173994 A1 * 6/2015 Chen ..... A61H 3/00 280/639
2015/0216757 A1 8/2015 Powell et al.
2015/0306440 A1 10/2015 Bucher et al.
2015/0320633 A1 11/2015 Jacobs
2015/0335940 A1 11/2015 Johnson
2016/0035228 A1 2/2016 Cakmak
2016/0074262 A1 3/2016 Moses et al.
2016/0120731 A1 5/2016 Vanausdall
2016/0151230 A1 6/2016 Bagheri
2016/0253890 A1 9/2016 Rabinowitz et al.
2016/0287465 A1 10/2016 Rabin et al.
2016/0296409 A1 10/2016 Schraudolph et al.
2016/0331610 A1 11/2016 Brown et al.
2016/0331626 A1 11/2016 Fellingham et al.
2017/0008544 A1 * 1/2017 Kindberg ..... A61H 3/04
2017/0065479 A1 * 3/2017 Fellingham ..... A61H 3/04

(56) References Cited

U.S. PATENT DOCUMENTS

| | | | | |
|---|---|---|---|---|
| 2017/0112706 | A1 | 4/2017 | Bruk et al. | |
| 2017/0175997 | A1 | 6/2017 | Rosenblum | |
| 2017/0209319 | A1 | 7/2017 | Fawcett | |
| 2017/0216125 | A1 | 8/2017 | Hyde et al. | |
| 2017/0224573 | A1 | 8/2017 | Challa | |
| 2017/0231857 | A1 | 8/2017 | Vanausdall | |
| 2017/0239130 | A1 | 8/2017 | Rizzo | |
| 2017/0258664 | A1* | 9/2017 | Purcell | A61H 3/04 |
| 2017/0354564 | A1 | 12/2017 | Dirauf et al. | |
| 2018/0250189 | A1 | 9/2018 | Johnson | |
| 2018/0280226 | A9 | 10/2018 | Fellingham et al. | |
| 2018/0360686 | A1 | 12/2018 | Fellingham et al. | |
| 2019/0105220 | A1* | 4/2019 | Pan | A61H 3/04 |
| 2019/0105221 | A1 | 4/2019 | Pan et al. | |
| 2019/0105222 | A1* | 4/2019 | Fellingham | A61H 1/00 |
| 2019/0183719 | A1 | 6/2019 | Koscielski et al. | |
| 2019/0209418 | A1 | 7/2019 | Vanausdall | |
| 2019/0231632 | A1 | 8/2019 | Hoekelmann et al. | |
| 2019/0247266 | A1 | 8/2019 | Pan et al. | |
| 2019/0254918 | A1 | 8/2019 | Fellingham et al. | |
| 2019/0365592 | A1 | 12/2019 | Norton et al. | |
| 2020/0078257 | A1* | 3/2020 | Miller | A61H 3/04 |
| 2020/0078258 | A1 | 3/2020 | Kanaya et al. | |
| 2020/0206068 | A1 | 7/2020 | Fellingham et al. | |
| 2020/0315901 | A1* | 10/2020 | Fellingham | A61H 1/00 |
| 2020/0352816 | A1* | 11/2020 | Lu | A61H 1/00 |
| 2021/0100716 | A1* | 4/2021 | Farley | A61G 5/0825 |

FOREIGN PATENT DOCUMENTS

| | | |
|---|---|---|
| JP | 2012019831 A | 2/2012 |
| WO | 98/45167 | 10/1998 |
| WO | 2014153201 | 9/2014 |

OTHER PUBLICATIONS

Manton, et al., "Changes in the Use of Personal Assistance and Special Equipment from 1982 to 1989: Results from the 1982 and 1989 NLTCS," Gerontologist 33 (2):168-76 (Apr. 1993).

Laplante, et al., "Demographics and Trends in Wheeled Mobility Equipment Use and Accessibility in the Community," Assistive Technology, 22, 3-17, (2010).

Martins et al., "Assistive Mobility Devices focusing on Smart Walkers: Classification and Review, Robotics and Autonomous Systems," 60 (4), Apr. 2012, pp. 548-562.

(User manual), "Nitro Rollator item # RTL 10266," retrieved Mar. 29, 2019, 8 pages, Medical Depot, Inc., Port Washington, New York.

Wasson et al., "Effective Shared Control in Cooperative Mobility Aids," Proc. 14th Int. Florida Artificial Intelligence Research Society Conf, May 2001, pp. 5509-5518.

Neto et al., "Extraction of user's navigation commands from upper body force interaction in walker assisted gait," BioMedical Engineering OnLine 2010, 9:37.

Frizera et al., "The Smart Walkers as Geriatric Assistive Device. The SIMBIOSIS Purpose," SIMBIOSIS Project—Spanish National Program of R&D—DPI, Jan. 2008.

Einbinder et al., "Smart Walker: A tool for promoting mobility in elderly adults," JPRD, vol. 47, No. 9, 2010.

Frisoli et al., "Technical Area Overview for the IEEE Technical Committee on Haptics," IEEE TCH, Dec. 2012.

Schmidt, "HapticWalker—A novel haptic device for walking simulation," Proceedings of EuroHaptics 2004, Munich, Germany, Jun. 5-7, 2004.

Morris et al, "A Robotic Walker That Provides Guidance," the Proceedings of IEEE International Conference on Robotics and Automation (ICRA '03), pp. 25-30, vol. 1.

Kulyukin et al., "iWalker: Toward a Rollator-Mounted Waytinding System for the Elderly," 2008 IEEE International Conference on RFID, The Venetian, Las Vegas, Nevada, USA, Apr. 16-17, 2008, pp. 303-311.

Drive Catalog, "Nitro Aluminum Rollator, Hemi Height, 10" Casters," DeVilbiss Healthcare, retrieved Mar. 29, 2019, 2 pages.

Perfect Walker II advertisement, NARFE Magazine, Sep. 2019, 1 page.

Alibaba website, "Lightweight Aluminum folding forearm rollator with bag and seat HCT-9102J," https://www.alibaba.com/product-detail/Lightweight-Aluminium-folding-forearm-rollator-with_60744547819.html, Publication date unknown, site visited Sep. 9, 2019.

HCT Medical website, "Forearm Rollator HCT-9137B," https://www.hct-medical.com/forearm-rollator-hct-9137b, Publication date unknown, site visited Sep. 9, 2019.

Frizera-Neto, Anselmo et al., "Empowering and Assisting Natural Human Mobility: the Simbiosis Walker," International Journal of Advanced Robotic Systems 8.3 (2011): 29. Mar. 2, 2011, 17 pages.

Sierra M., Sergio D. et al., "Human-Robot-Environment Interaction Interface for Smart Walker Assisted Gait: AGoRA Walker," Sensors 19.13 (2019): 2897, Jun. 30, 2019, 29 pages.

* cited by examiner

COLLAPSIBLE WHEELED WALKER WITH STABILITY ENHANCING BRACKET APPARATUS AND METHOD

CROSS-REFERENCE TO RELATED APPLICATIONS

The present application claims the benefit of U.S. Provisional Application No. 62/830,183, filed Apr. 5, 2019, the contents of which are expressly incorporated herein by reference.

STATEMENT RE: FEDERALLY SPONSORED RESEARCH/DEVELOPMENT

Not Applicable

BACKGROUND

Technical Field

The present inventive subject matter generally relates to assistive mobility devices and more particularly to a collapsible wheeled walker or rollator with a folding mechanism that includes a releasably engageable bracket to securely hold the folding mechanism in place when the apparatus is fully deployed for increased stability and other benefits.

Background

Assistive mobility devices, including walkers or rollators, are widely used by mobility impaired individuals. A detailed discussion of the use and classification of mobility assistance devices is discussed in U.S. Pat. No. 9,585,807 to Fellingham, issued on Mar. 7, 2017 and entitled Collapsible Upright Wheeled Walker Apparatus ("Fellingham"), the entire substance of which is incorporated herein by reference as though fully set forth herein.

Many existing wheeled walker and rollator devices were not designed to support significant user weight during use and are used for the accepted purpose of providing assistance in balance and gait. Use of such devices requires the user to engage the walker or rollator with the hands and wrists alone, often with a stooping and leaning posture. Fellingham discloses an apparatus with raised adjustable forearm support elements to provide upper body support to a user allowing the wheeled walker to support a significant amount of a user's weight while the user is walking. Fellingham discloses allowing a user to engage the wheeled walker in an upright walking position supported by the user's forearms and including two forward hand grips. The upright walking posture has the advantages reducing heart and lung compression, improves circulation and providing the therapeutic effects of longer walking times. Other currently pending applications disclose wheeled walkers supporting upright walking posture with supports for user's upper body or forearms and include U.S. Patent Application Publication No. 2019/0105221 filed Jan. 20, 2018 entitled Wheeled Walker with Movable Seat to Pan ("Pan") and U.S. Patent Application Publication No. 2019/0105222 filed Oct. 2, 2018 entitled Wheeled Walker to Fellingham ("Fellingham II"), the entire substance of both Pan and Fellingham II are incorporated herein by reference as though fully set forth herein.

Also, many of existing wheeled walkers and rollators include the ability to fold or collapse using folding mechanisms and are designed to keep the walker or rollator lightweight. In the deployed configuration, while such lightweight devices remain fixedly open, such folding mechanism designs do not have a robust support mechanism in the deployed or open configuration. For example, in some collapsible wheeled walkers and rollators may employ an x-folding apparatus that in the deployed configuration, the sides of the x-folder simply rest upon laterality placed stops, without fixedly holding sides in place. Latches on such prior devices may keep the devices from re-folding, but the latches do not provide for significant structural fixed support to resist lateral deformation or instability of the device.

As such, there is a need in the art to provide a lighter weight wheeled walker or rollator that provides for a collapsible system that in the deployed configuration holds the sides of the folding apparatus in fixed position to resist lateral instability. Also, there is a need in the art for wheeled walkers or rollators with raised adjustable forearm support elements to allow the upright walking of the user causing the wheeled walker or rollator to support significant weight of the user, to have a collapsible system that in the deployed configuration holds the sides of the folding apparatus in fixed position to resist instability.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

BRIEF SUMMARY

The inventive subject matter described herein demonstrates an apparatus and method for a collapsible wheeled walker or rollator that includes a folding mechanism that includes at least one releasably engageable bracket that securely holds the seat folding mechanism in place when the apparatus is fully deployed for increased stability and other benefits.

The disclosed device is a collapsible wheeled walker that has first and second side frames. The side frames each have opposed inner and outer sides, with the inner sides facing each other inwardly, and the outer sides facing outwardly, away from the center of the wheeled walker. Each side frame incudes a plurality of coupled members. At the bottom of each of the side frames there is an elongate base member extending longitudinally from the rear to the front of the walker device and to which are coupled a plurality of wheel assemblies. In a shown embodiment, the elongate base member has first and second sides, with the front end of each side having an attached front wheel assembly and the rear end of each side having a rear wheel assembly. A strut member is coupled to the base member at a point between the first front end and second rear end of the base member and extends upwardly from said base member. A portion of the strut member may extend upwardly from the base member at an angle toward the back of the device. The strut members are adjustably coupled to forearm supports that can be adjusted upwardly and downwardly to adjust to the height of the user. The height adjustment uses an extension member that has graduated holes adapted to engage a button and pin arrangement. When the adjustment member is received within the strut member and is positioned to the desired location, a pin may engage a graduated hole to hold the adjustment member at the proper location with the adjustment member telescoping upwardly and downwardly into the strut member and locking into the desired height by a user. A bracket support member is also part of each of the side frames and the bracket support is coupled to strut member and extends longitudinally forward from the strut member. Two brackets are positioned on each of the inner sides of the first and second frames along respective bracket support members, and each of said brackets have a support surface and including at least one protrusion extending from the support surface.

An X-folder apparatus interconnects the first and second side frames with the first and second side frames positioned with the inner side of the first frame facing the inner side of the second frame. The X-folder apparatus includes a first cross member having a first and second ends, the first end of the first cross member is pivotally connected to the base member of the first side frame, the second end of the first cross member is coupled to an elongate support member, the elongate support member of the first cross member having two apertures or openings. The second cross member is similarly constructed having first and second ends, the first end of the second cross member being pivotally connected the base member of the second side frame and the second end of the second cross member being coupled to an elongate support member and the elongate support member of the second cross member having two apertures or openings.

In the deployed open position, the elongate support members of the first and second cross members are received on the support surfaces of the support brackets of the bracket support members of the first and second frames, and the protrusions of the support brackets are received in the respective apertures of the elongate support members of the first and second cross members. The brackets may be c-shaped and have a complementary shape to that of the support members so that they are received in a nested friction fashion to assist in holding the support members in place. Also, the protrusions may be conically shaped and extend from the support surface of the bracket to engage the openings of the support members to provide additional stability. Latch mechanisms also engage the cross members to linkages to hold the device in the open deployed position during operation, but the latches release upon the cross members being rotated upwardly. A fabric seat is attached to the tops of the support members so that in the open position, a seat is formed for use.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
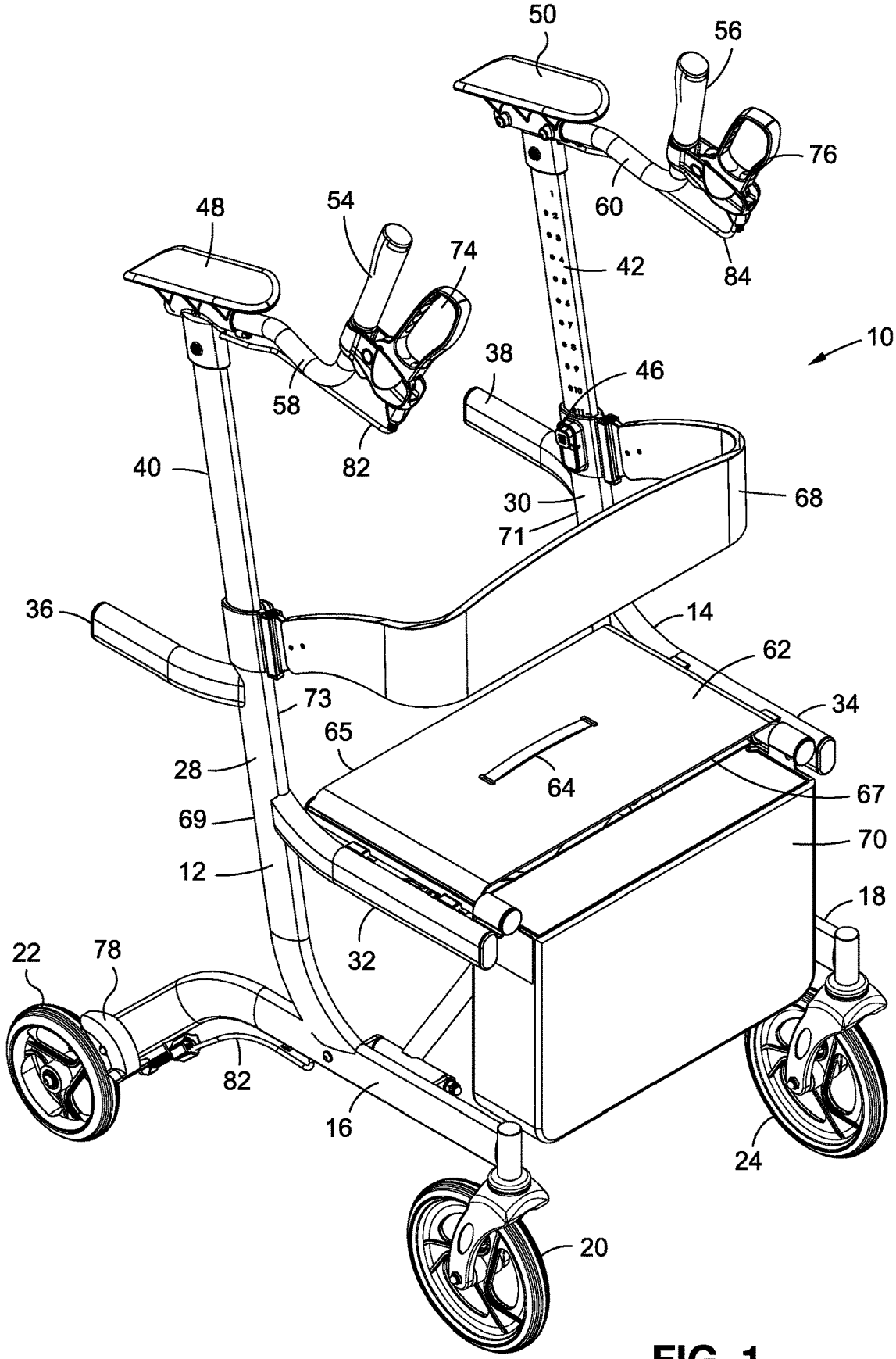
FIG. 1 is a front perspective view of the disclosed wheeled walker device.

The detailed description set forth below in connection with the appended drawings is intended as a description of certain embodiments of a collapsible wheeled walker apparatus and related method of use and is not intended to represent the only forms that may be developed or utilized. The description sets forth the various structure and/or functions in connection with the illustrated embodiments, but it is to be understood, however, that the same or equivalent structure and/or functions may be accomplished by different embodiments that are also intended to be encompassed within the scope of the present disclosure. It is further understood that the use of relational terms such as first and second, and the like are used solely to distinguish one entity from another without necessarily requiring or implying any actual such relationship or order between such entities.

The background, summary and the above description includes information that may be useful in understanding the present disclosure. It is not an admission that any of the information provided herein is prior art or relevant to the presently claimed inventive subject matter, or that any publication specifically or implicitly referenced is prior art.

In some embodiments, the numbers expressing dimensions, quantities, quantiles of ingredients, properties of materials, and so forth, used to describe and claim certain embodiments of the disclosure are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the disclosure are approximations, the numerical values set forth in the specific examples are reported as precisely as practicable. The numerical values presented in some embodiments of the disclose may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the disclosure and does not pose a limitation on the scope of the claimed inventive subject matter. No language in the specification should be construed as indicating any non-claimed element essential to the practice of the inventive subject matter.

Groupings of alternative elements or embodiments of the inventive subject matter disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed. Various objects, features, aspects and advantages of the inventive subject matter will become more apparent from the following detailed description of preferred embodiments, along with the accompanying drawing figures in which like numerals represent like components.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C and N, the text should be interpreted as requiring only one element from the group, not A plus N, or B plus N, etc.

Figure 2:
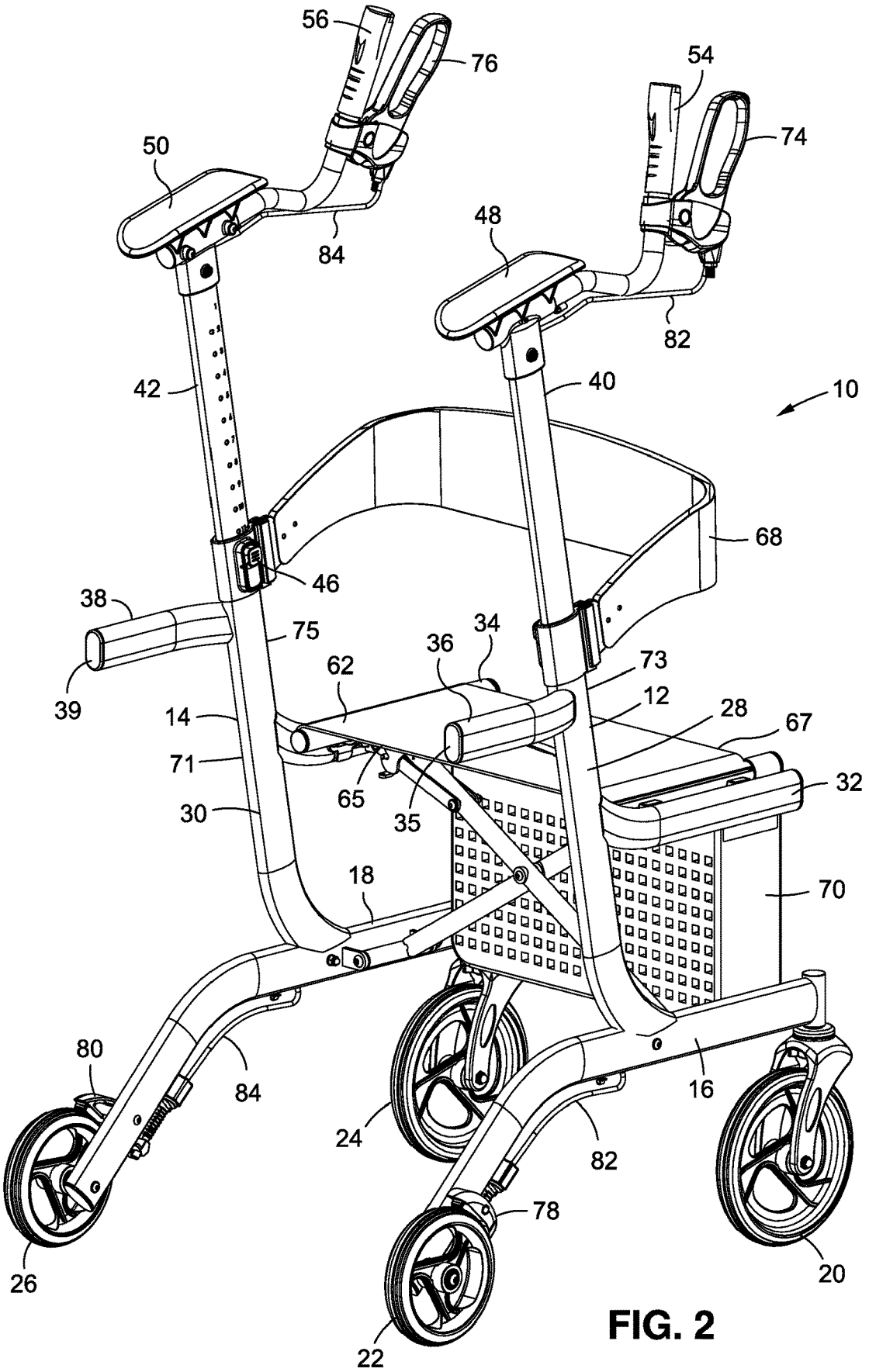
FIG. 2 is a rear perspective view of the disclosed wheeled walker device.
Figure 3:
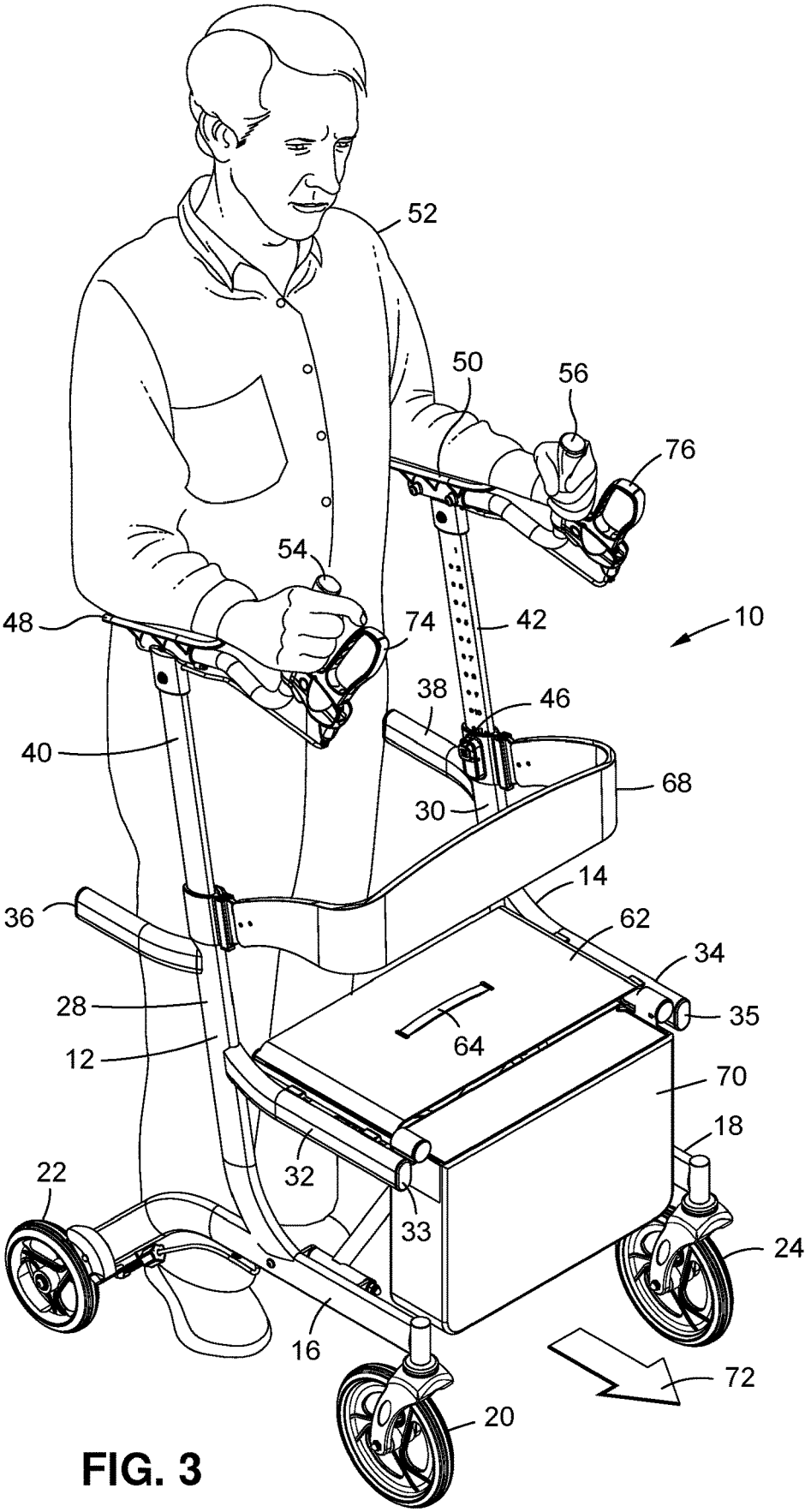
FIG. 3 is the front perspective view of the device as shown in FIG. 1 with a user interacting with the device.

Referring particularly to FIG. 1-3, there is shown a collapsible wheeled walker apparatus 10 with a first side frame 12 and a second side frame 14 frame. Each of the side frames 12 and 14 have mirror image construction. The frames 12 and 14, as well as other components that are included in the structure of device 10 may be made from a lightweight aluminum alloy such as 6061 or 6063, however any suitable rigid material may be used. Frame 12 includes a base member 16 coupled to wheel assemblies 20 and 22. The base member 16 extends longitudinally along the bottom of the frame 12 between the front wheel assembly 20 and rear wheel assembly 22. A strut member 28 is coupled to the base member 16 and extends upwardly from the base member 28. A bracket support member 32 of frame 12 is coupled to strut 28 and extends longitudinally forward from strut 28. Frame 12 also includes a lower handle member 36 coupled to strut 28 and extending longitudinally rearwardly from strut 28 (e.g., in a direction opposite to that of the bracket support member 32). Frame 14 includes a base member 18 coupled to wheel assemblies 24 and 26. The base member 18 extends longitudinally along the bottom of the frame 14 between the front wheel assembly 24 and rear wheel assembly 26. A strut member 30 is coupled to the base member 18 and extends upwardly from the base member 18. A bracket support member 34 of frame 14 is coupled to strut 30 and extends longitudinally forward from strut 30. Frame 14 also includes a lower handle member 38 coupled to strut 30 and extending longitudinally rearwardly from strut 30.

The wheeled walker apparatus 10 additionally includes two upper adjustment members 40 and 42 inserted into and slidably engaged into struts 28 and 30, respectively. Locking pins (not shown) are engaged and disengaged by respective lock buttons 44 and 46 to operate and lock respectively slidably engaged upper adjustment members 40 and 42 at a selectable elevation above a walking surface for a particular user height. Support members or forearm gutters 48 and 50 are attached to the top of the adjustment members 40 and 42 respectively. In one embodiment, forearm gutters 48 and 50 are oval shaped and have a curved interior surface configuration in order for a user 52 (shown in FIG. 3) to comfortably rest forearms in the gutters 48 and 50. It can be appreciated that the forearm supports 48 and 50 can be formed of any suitable shape and structure to anatomically engage a user's forearms or other body parts to the wheeled walker 10. Handles 54 and 56 are positioned forward of the forearm supports 48 and 50, respectively. Handles 54 and 56 are coupled to the upper adjustment members 40 and 42 via handle connection members 58 and 60 respectively. Each of the handles 54 and 56 include brake handles 74 and 76, respectively. Brake handles 74 and 76 operate brake mechanisms 78 and 80 respectively through brake cables 82 and 84 which may pass through the hollow structures of the adjustable members 40 and 42 and side frames 12 and 14. The brake mechanisms 78 and 80 may be deployed in at least two ways. When a user squeezes the brake handles 74 and/or 76 it causes the brake mechanisms 78 and/or 80 to engage. Also a user may push the brake handles 74 and/or 76 downward to apply the mechanisms 78 and 80 to act as wheel locks when the walker device 10 is stationary to avoid rolling, or when a user may wish to use the seat 62.

Figure 8:
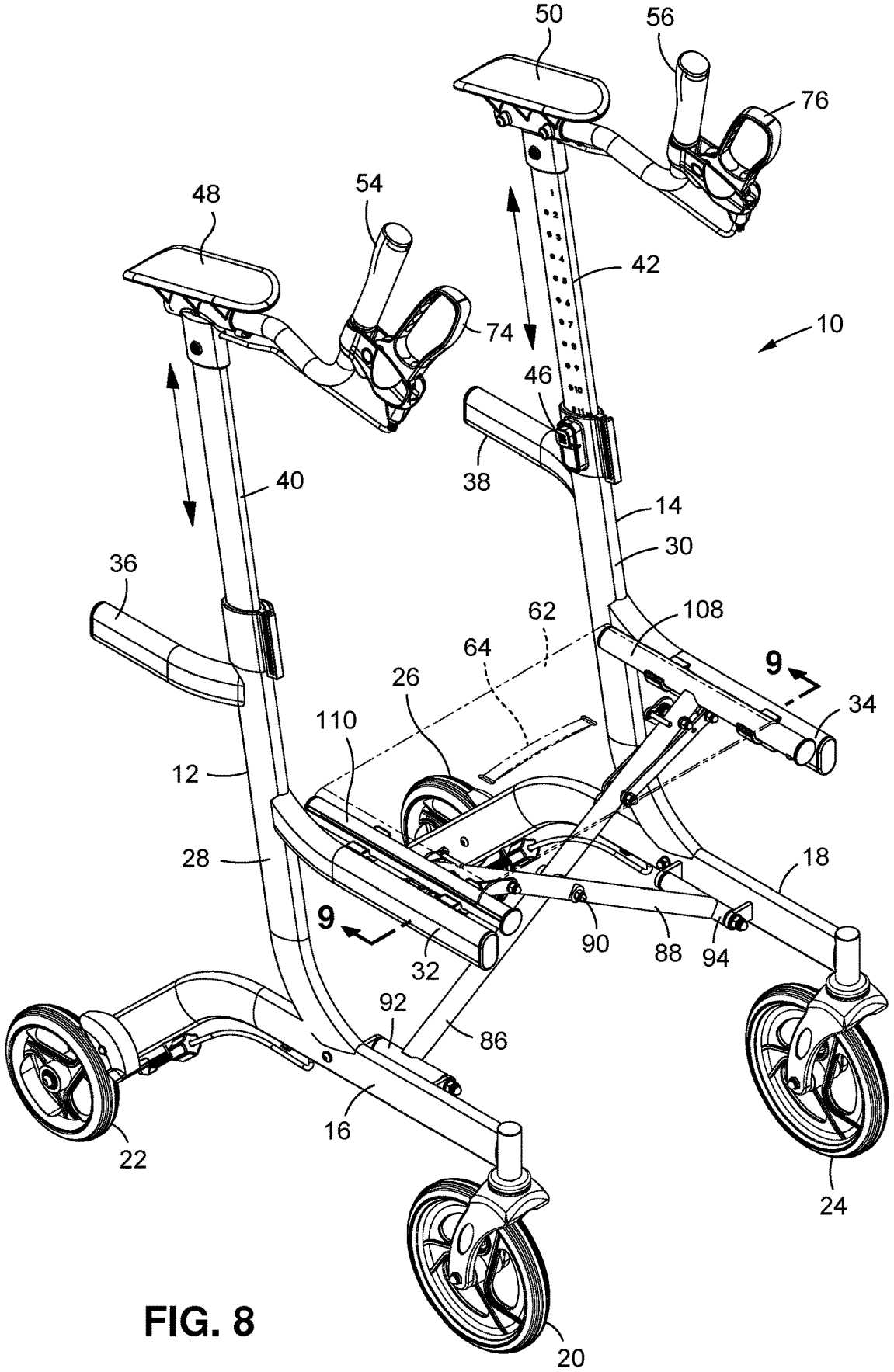
FIG. 8 is a front perspective view of disclosed wheeled walker device shown without the utility bag, and with the seat shown in broken lines.

A seat 62, formed of a pliable material, such as fabric or mesh, is also provided to extend between the bracket support members 32 and 34 attached an X-folder apparatus which is discussed in greater detail with regard to FIG. 8. A seat handle 64 is provided to allow a user to pull up on the handle 64 to collapse the walker 10, described in more detail with regard to FIGS. 8-9. The walker device 10 may provide accessories such as a back support 68 for a user when in the seated position on the seat 62. The back support 68 extends between struts 28 and 30 and is formed in a U-shaped configuration to provide space and placement at the far end of seat 62 to allow a user to be seated on seat 62 without the back rest 68 interfering with the user. Other accessories may include a mesh or fabric bag 70 which can be placed on forward part of the walker 10 for the user to be able to stow items within the bag 70.

The seat 62 may include a rear peripheral edge 65 and a front peripheral edge 67. The wheeled walker apparatus 10 may be configured such that the rear peripheral edge 65 may be positioned generally forwardly, so as to mitigate undesirable contact with the user's legs when the user is walking. In this regard, the rear peripheral edge 65 may be positioned in front of a rear edge 69, 71 of the struts 28, 30, at least as to the plane in which the seat 62 extends when the seat 62 is deployed. In another embodiment, the rear peripheral edge may be positioned in front of the entirety of the struts 28, 30, such that there is a gap between the rear peripheral edge 65 and the front edge 73, 75 of the struts 28, 30. The forward position of the seat 62 may keep the seat 62 in front of the middle of the user's forearms resting in the gutters 48, 50.

Referring to FIG. 3, during use, after adjusting adjustment members 40 and 42 to a desired elevation above a walking surface, a user 52 stands and steps between side frames 12 and 14 and grasps handles 54 and 56 with each hand while resting forearms in respective forearm supports 48 and 50, thereby resting at least some body upper body weight on the walker apparatus 10 while standing on the walking surface. The user 52 may then walk forward in the direction as shown by the arrow 72 as the walker apparatus 10 rolls over the walking surface while supporting at least some weight of the user 52 with forearm supports 48 and 50, thereby reducing user leg effort and improving user stability and thereby augmenting the user's ability to step along a walking surface without the assistance of another person. As noted above, the forward positioning of the seat 62 reduces the likelihood of interference between the seat 62 and the user's when the user is walking. During walking, a user 52 may engage brakes using one or both of the brake handles 74 or 76 to slow progress or to counter a feeling of instability. Each of the lower handles 36 and 38 are disposed respectively on struts 28 and 30 to permit user 52 to grasp lower handles 36 and 38 and move forward, using walker apparatus 10 only for stability and guidance without forearm support, more in line with a non-forearm support walker device. The lower handles 36 and 38 may be additionally useful for a user to pull themselves up from a seated position (not shown) to engage the walker device 10. Also, the ends of the lower handles 36 and 38 (35 and 39 as best shown in FIG. 2) may include reflectors or reflective material to increase visibility of the walker device 10 at night when in use. Likewise, the ends 33 and 35 of the bracket support members 32 and 34, respectively, may include reflectors or reflective material to increase visibility of the walker device 10 at night when in use. It is to be understood and appreciated that the user 52 shown in FIG. 3 may not be to scale relative to the walker device 10 and is provided for exemplary discussion of the use of the device 10.

Figure 4:
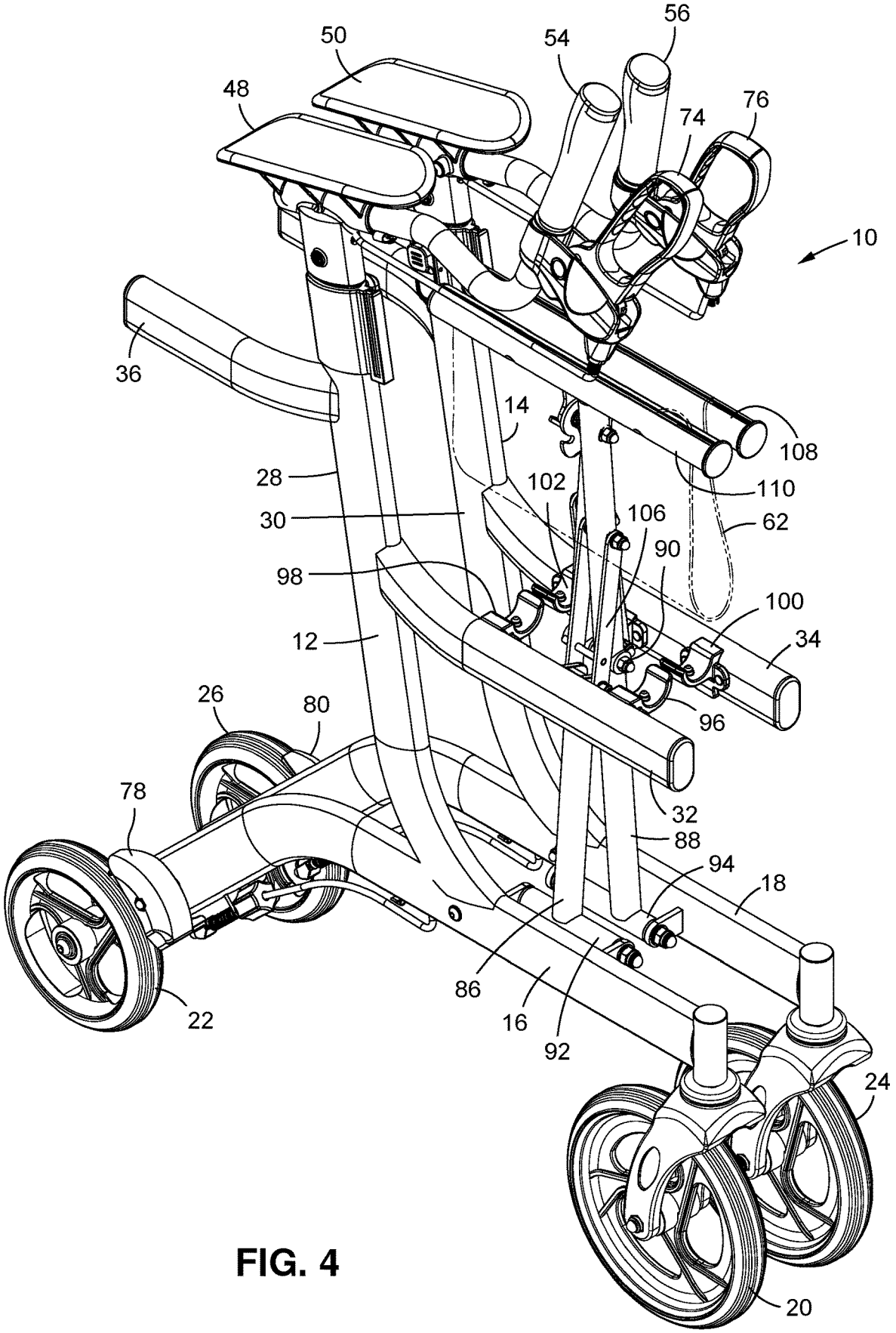
FIG. 4 is a front perspective view of the disclosed wheeled walker device in a collapsed configuration.
Figure 5:
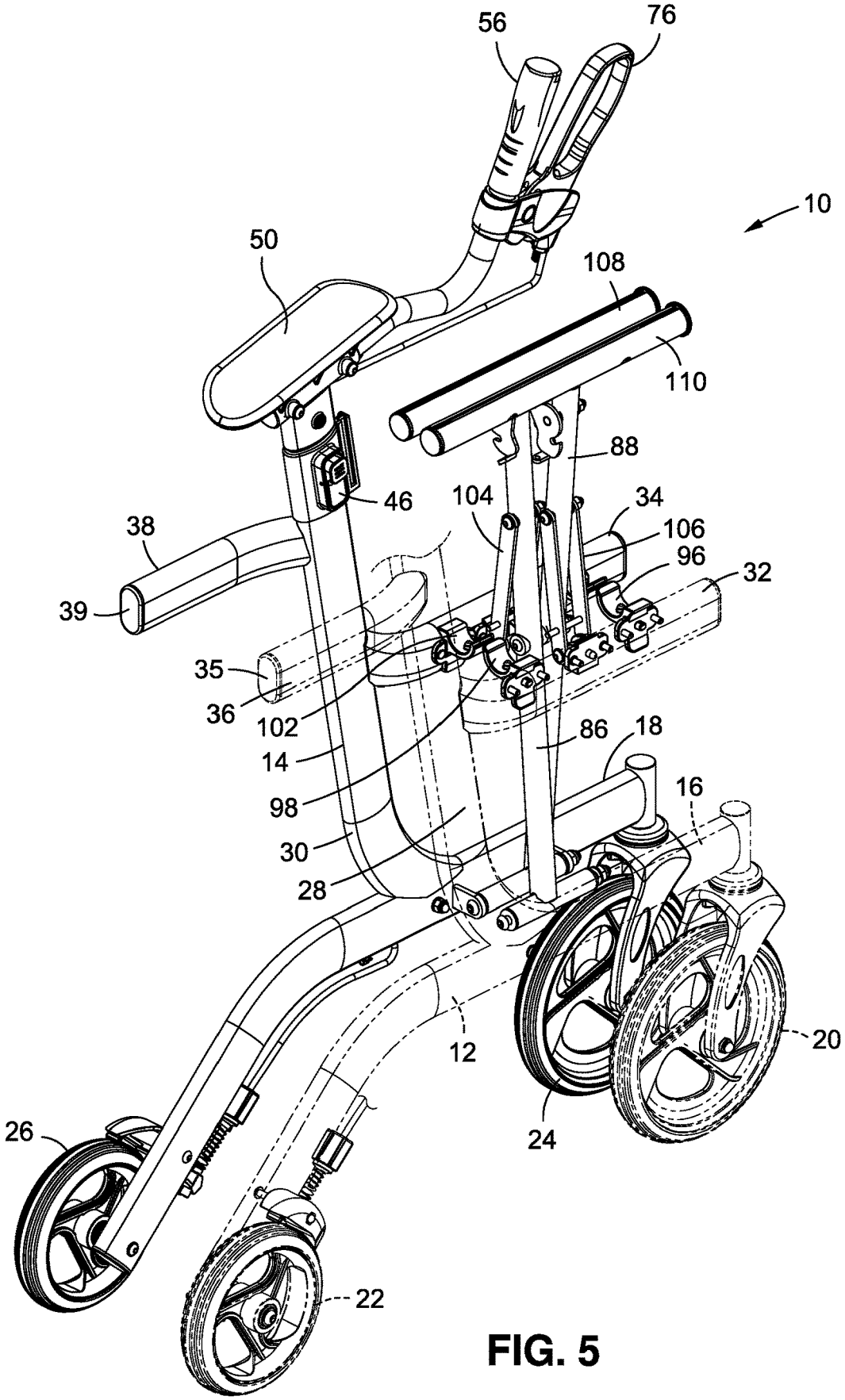
FIG. 5 is a rear perspective view of the disclosed wheeled walker device in a collapsed configuration, with the right frame side and wheels shown in broken lines.
Figure 7:
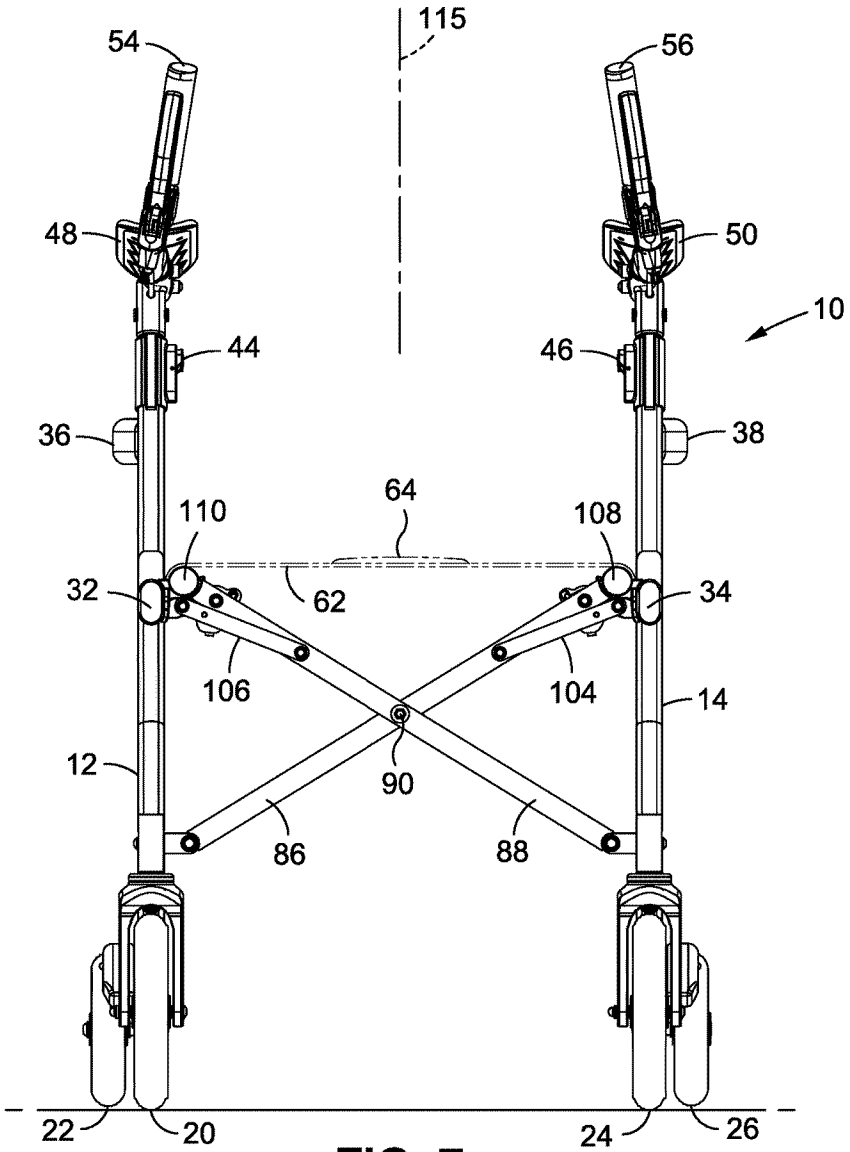
FIG. 7 is front view of the disclosed wheeled walker device shown in the deployed configuration.
Figure 6:
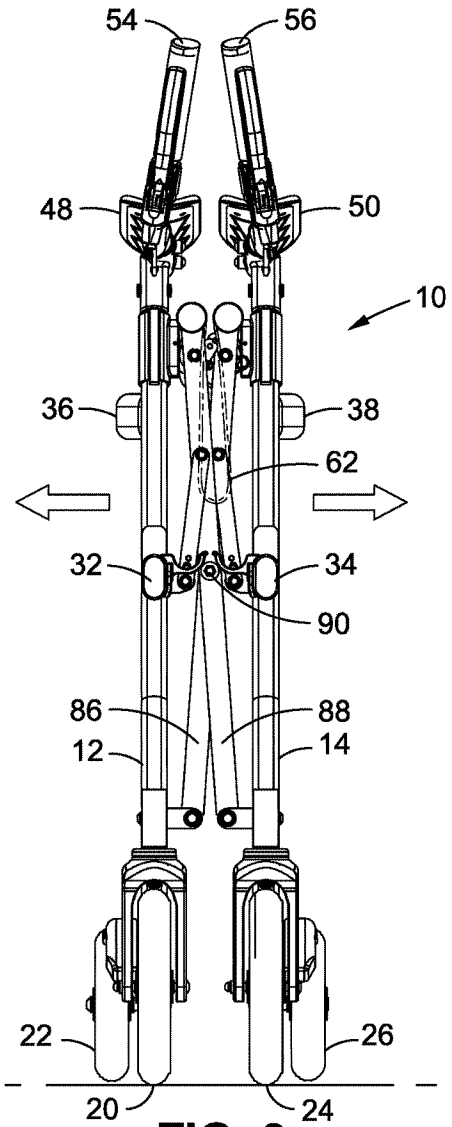
FIG. 6 is a front view of the disclosed wheeled walker device shown in the collapsed configuration.

Referring to FIGS. 4 and 5, the walker device 10 is shown in the collapsed configuration, with FIG. 5 showing side frame 12 in broken lines to provide a view of the X-folder interconnecting side frames 12 and 14. The X-folder apparatus comprises cross member 86 and cross member 88 which are pivotably connected at a pivot 90 to allow a scissor like movement of the cross members 86 and 88. Cross member 86 is pivotally connected to side frame 12 on the inner side of base member 16 via a perpendicular end member 92. Likewise, cross member 88 is pivotally connected to side frame 14 on the inner side of base member 18 via a perpendicular end member 94. Bracket support members 32 support brackets 96 and 98, and bracket support member 34 supports brackets 100 and 102. Cross member 86 is also attached to bracket support member 34 through pivot linkage 104 that is pivotally connected to bracket support member 34 on a first side and pivotally connected to the cross member 86 on a second side. Likewise, cross member 88 is pivotally connected to bracket support member 32 through pivot linkage 106 that is pivotally connected to bracket support member 32 on a first side, and pivotally connected to the cross member 88 on a second side. Cross member 86 also has a perpendicular support member 108 coupled at end of the cross member 86 opposite of pivot connection 92. Likewise, cross member 88 has a perpendicular support member 110 coupled at the end of cross member 88 opposite the pivot connection 94. FIGS. 6 and 7 show the movement of the X-folder components from a first collapsed position shown in FIG. 6 to an open deployed position in FIG. 7.

Figure 9:
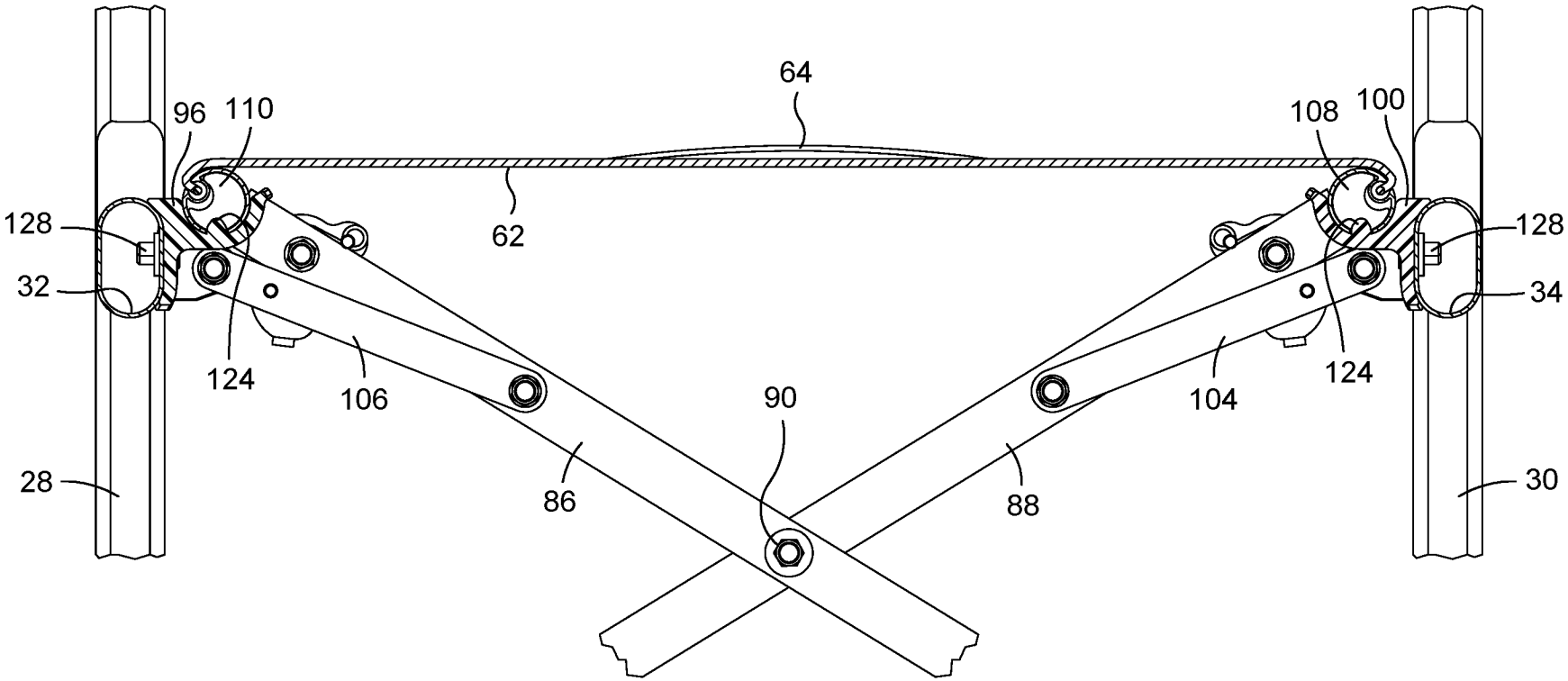
FIG. 9 is a front cross-sectional view 9-9 as shown in FIG. 8.

Referring to FIGS. 8 and 9, there is shown the position of the fabric or pliable material seat 62 coupled to the support members 108 and 110. In the deployed position the seat 62 is pulled to its maximum width to assume a generally horizontal, planar configuration as the support members 108 and 110 are moved laterally away from each other on opposite sides of a vertical central axis 115, which resides equidistantly between the side frames 12, 14. FIG. 9 shows a cross sectional view of the engagement of the support members 108 and 110 with brackets 100 and 96 respectively. The brackets 100 and 96 have c-shaped support surfaces which are complementary to the circular cross sections of the support members 108 and 110. As such, the nesting of the support members 108 and 110 into the support brackets 100 and 96 provides a more secure engagement.

Figure 10:
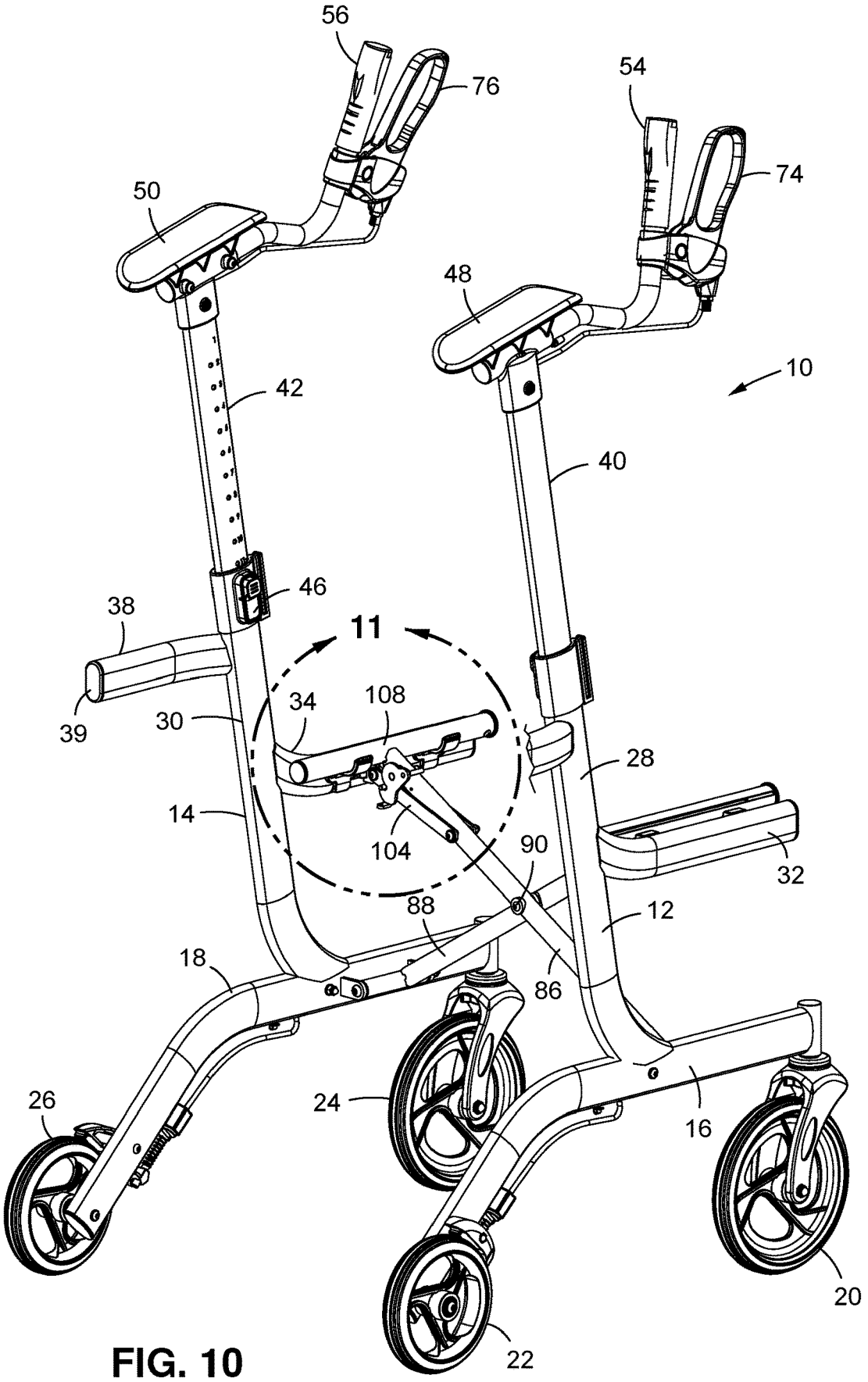
FIG. 10 is a rear side view of a portion of the frame and wheel assemblies of the disclosed wheeled walker device.
Figure 11:
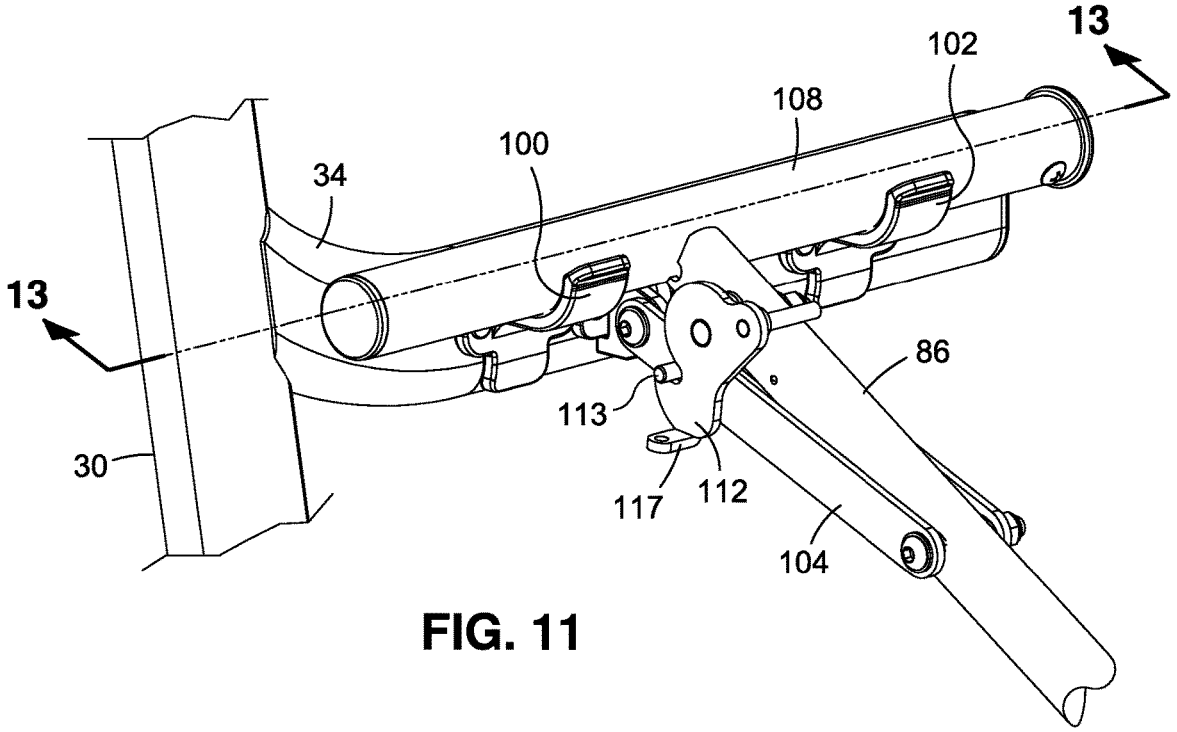
FIG. 11 is the focus area 11 identified in FIG. 10, showing a portion of the x-folder mechanism engaged with the side frame.

Referring to FIGS. 10 to 13, FIG. 11 shows a closer view of the region of interest 11 in FIG. 10. Perpendicular support member 108 is received into support brackets 100 and 102.

Figure 12:
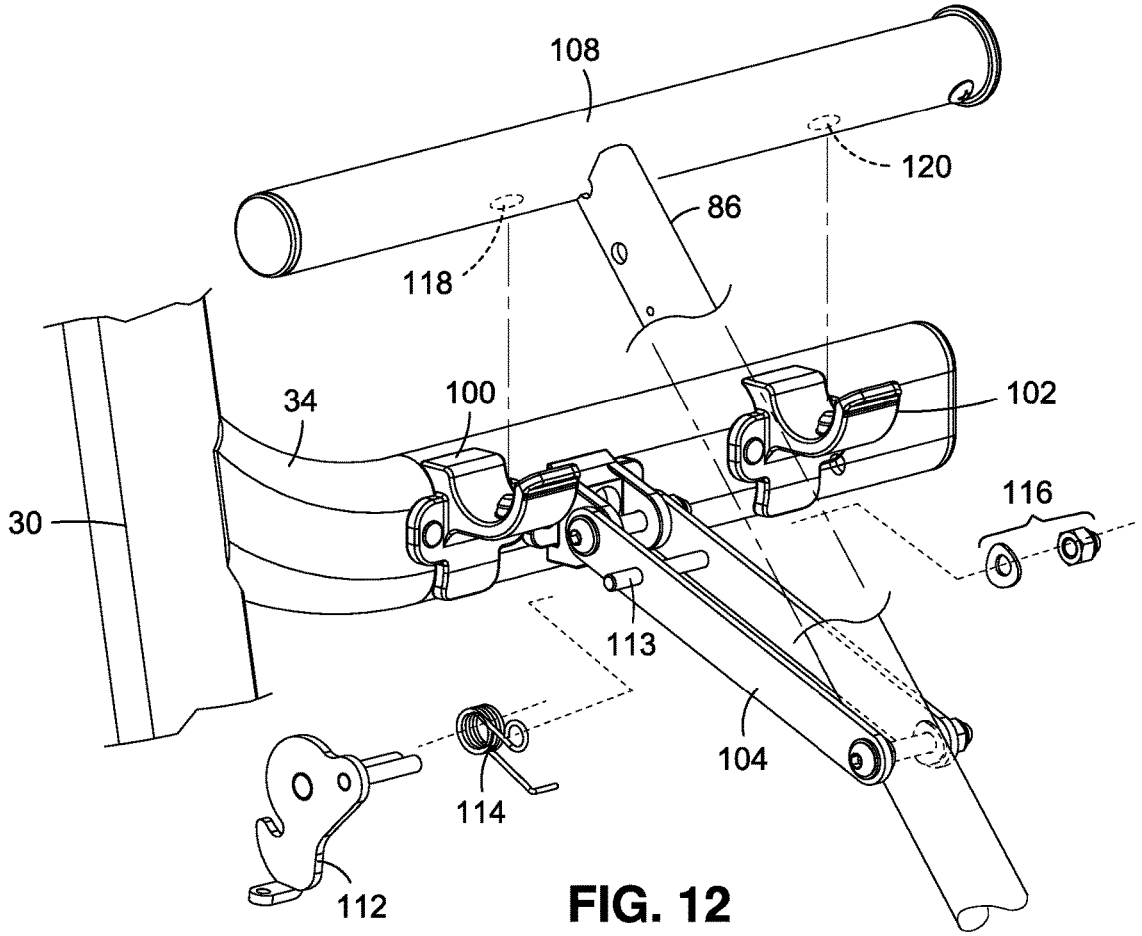
FIG. 12 shows the portion of the x-folder mechanism and side frame depicted in FIG. 11, with the x-folder mechanism released from the side frame and items exploded from position.
Figure 13:
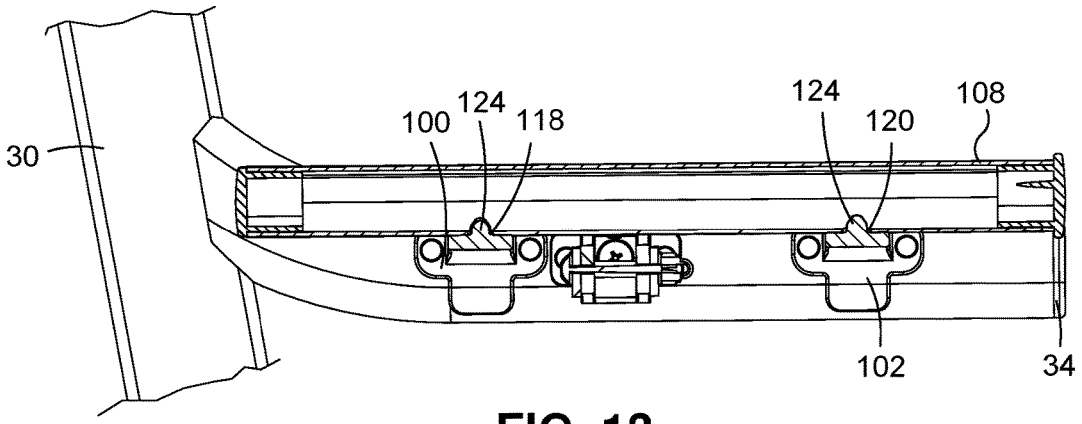
FIG. 13 is a cross sectional view 13-13 as shown in FIG. 11.

When the support member 108 and brackets 100 and 102 are engaged, a pivotally connected latch 112, coupled to cross member 86, engages a locking pin 113, coupled to linkage 104, to lock the X-folder components in place to prevent inadvertent removal of the support member 108 from the brackets 100 and 102). However, when the seat 62 is pulled by handle 64 to move the cross members 86 and 88 upwardly, the latch 112 releases by virtue of the handle 64 being interconnected to the latch 112. For instance, the handle 64 may be connected to a ring (not shown) which is linked to the flange 117 formed on latch 112. Latch 112 is spring biased by spring 114 and pivotally attached on the opposite side of cross member 86 by a nut and washer 116. An identical latch mechanism is attached on cross member 88 (see FIG. 19 latch 111). As is shown in FIGS. 12 and 13, perpendicular support member 108 (as well as opposite support member 110, not shown) has two apertures 118 and 120 which are aligned to receive protrusions 124 on the support surfaces 122 of brackets 110 and 102. The insertion of the protrusions 124 into the apertures 118 and 120 (as well as apertures formed in opposite support member 110, not shown) provide enhanced stability to the X-folder and side frames 12 and 14 in the deployed position, which may be important for safety of the device 10. The interconnection of the latch 112 to locking pin 112 (and opposite latch 111 to a corresponding locking pin) may facilitate deep advancement of the protrusions 124 into the apertures 118 and 120 and retain the protrusions 124 therein to maintain engagement between the support member 108 and the brackets 100 and 102. When the vertical motion of the protrusions 124 relative to the support members 108 and 110 is constrained by the latches 112 and 111, respectively, the following may be achieved: the left side support member 108 is coupled to resist side-to-side and front-to-rear displacement, directly via the protrusions 124 in the support member 108 via apertures 118 and 120; and via the rigid triangulated structure of the X-folding mechanism link to the right side walker frame 12 similar rigidity is achieved on the right side of the walker 10, via the same mechanism through support member 110, protrusions 124 and latch 111. The left frame 14 and right frame 12 are thus strongly coupled in multiple axes, via the triangulated X-folder structure (See FIG. 19). Also, in cases where the supports 48 and 50 are used to support the weight of the upper body of a user, the additional weight is maintained in a more secure way to avoid deformation or instability of the device 10. The protrusions 124 of the brackets 100 and 102, for example, along with the c-shaped support surface 122 aid in keeping the member 108 (and member 110) from shifting within the brackets 100 and 102 (and member 110 in opposite brackets 96 and 98) while further held rigid by latches 111 and 112 forming a sturdy triangular structure. Triangles are an efficient way to add structural stiffness to a frame structure for a given weight of material. Forces applied to a closed triangle may pass down the length of the three links, trying to lengthen or shorten the links; rather than bend them. In summary, the structures shown in FIGS. 10-16 increase torsional strength and shear stiffness to reduce temporary frame distortion of the walker device 10 in the open deployed position. Importantly, at the forearm support members 48 and 50, where the user interfaces with the walker device 10, flex induced displacement is resisted with improved structural stiffness, which is discussed further in relation to FIGS. 19-22.

Figure 14:
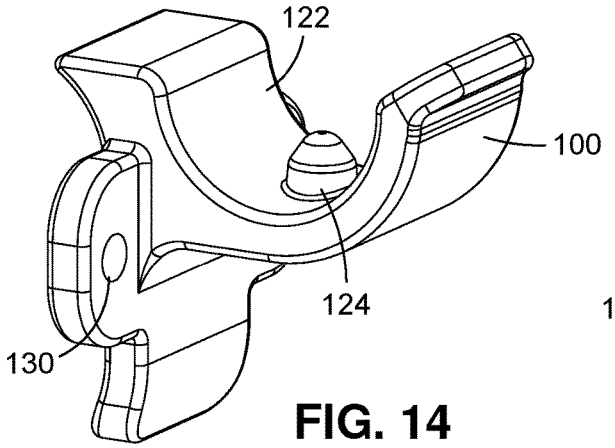
FIG. 14 is a front perspective view of a support bracket.
Figure 15:
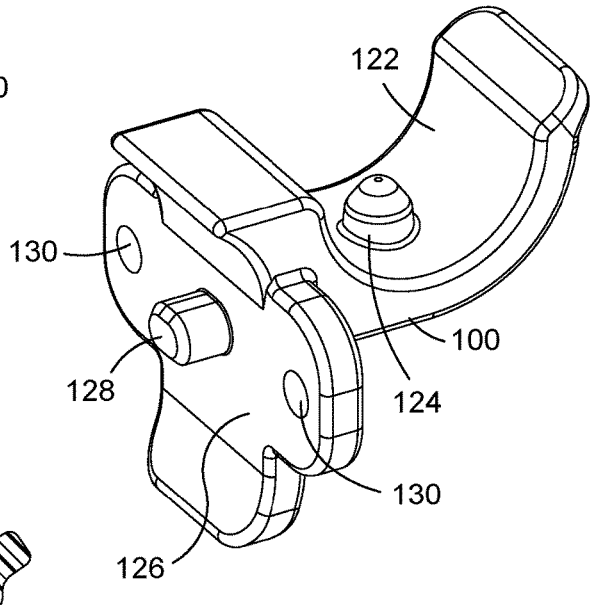
FIG. 15 is a rear perspective view of a support bracket.
Figure 16:
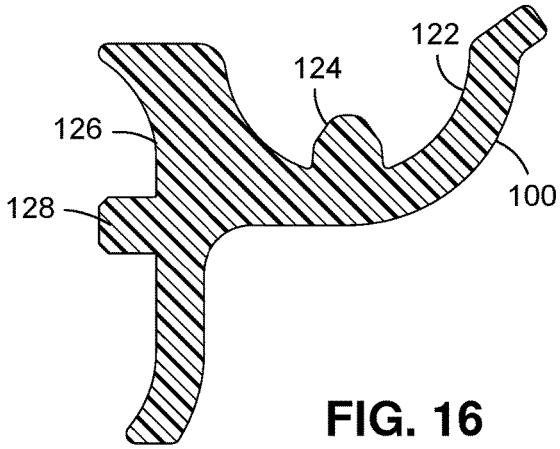
FIG. 16 is a side cross sectional view a support bracket.

Referring to FIGS. 14 through 16, representation of bracket 100 is shown, however it should be noted that brackets 102, 96 and 98 are formed identically. The bracket 100 includes a c-shaped support surface 122 that is formed complementary to the cross-sectional shape of the support members 108 and 110. The bracket 110 includes a protrusion 124 for being received into apertures provided in the in the support members 108 and 110 and as shown in FIG. 13, apertures 118 and 120. The bracket back 126 has a shape complementary to bracket support members 32 and 34, and a back protrusion 128 is provided to be received in apertures formed in bracket support members 32 and 34 (See FIG. 9). Brackets 100 include fastener apertures 130 for securing the brackets 110 to the bracket support members 32 and 34.

Figure 17:
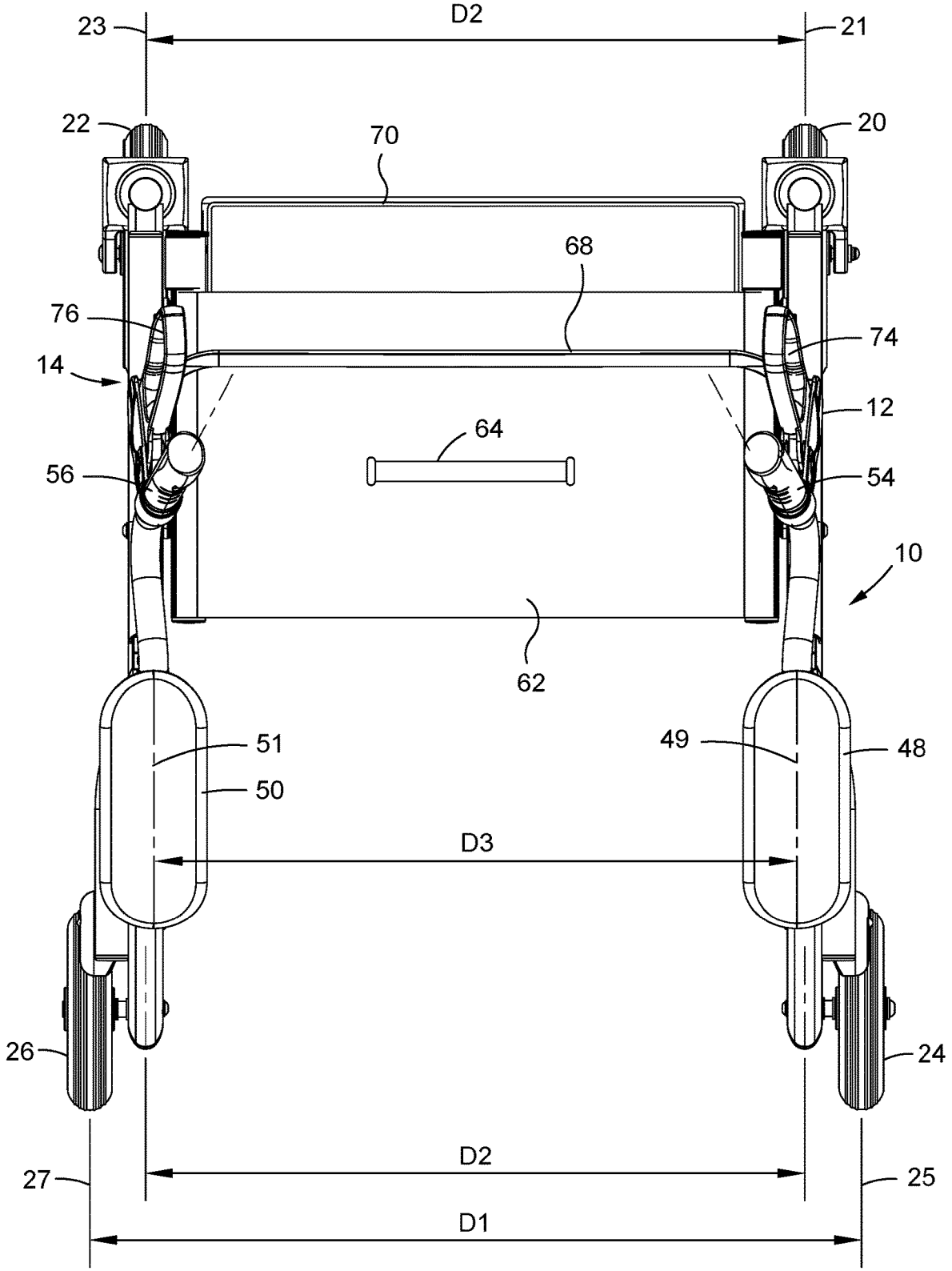
FIG. 17 is top view of the disclosed wheeled walker device.

Referring particularly to FIG. 17, there is shown a top view of the walker device 10. The forearm support members 50 and 48 are formed in parallel relation to each other. The centerlines 49 and 51 of the support members 48 and 50, respectively, are in parallel and set inside of the of the centerlines 21 and 23 of the front wheels 20 and 22, respectively. As such distance D3 is less than distances D1 and D2. The interior placement of the centerlines 51 and 49 inside the centerlines of front wheels 21 and 23, and well inside the centerlines of the rear wheels 25 and 27 provides a stable center of gravity for the walker device 10, while providing additional clearance between the forearm supports 48 and 50 for a user using the seat 62.

Figure 19:
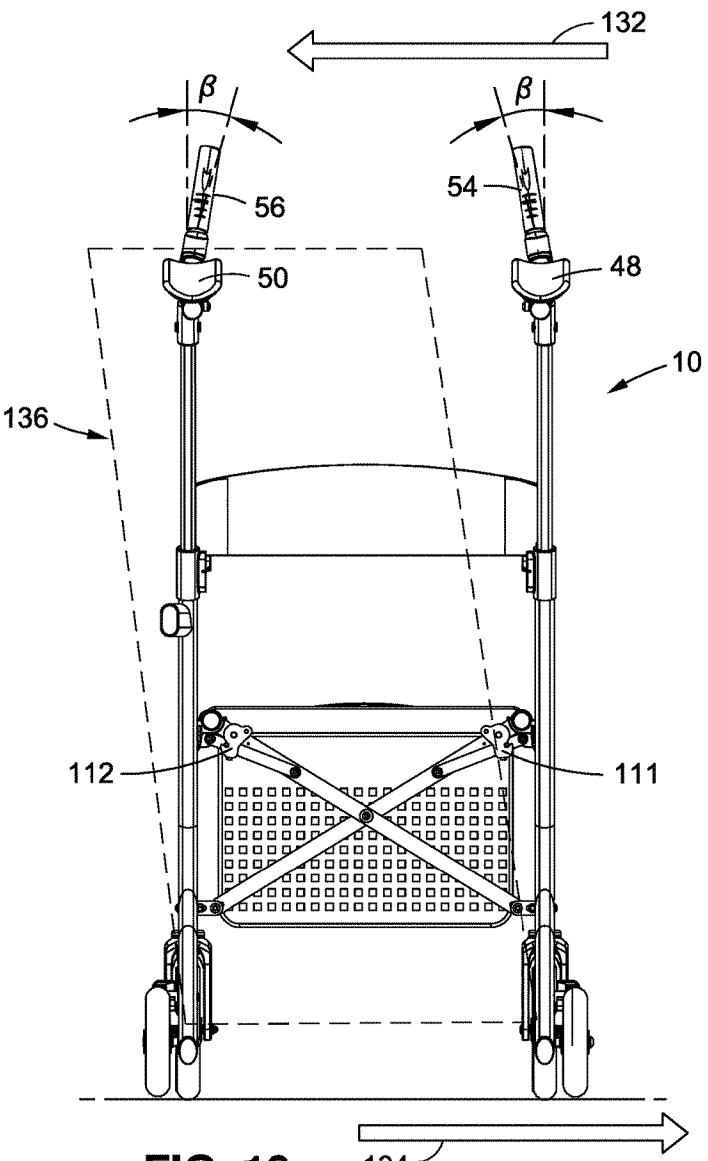
FIG. 19 is a rear view of the disclosed wheeled walker device showing the angles of offset of the handle grips and arrows showing opposing lateral load forces.
Figure 18:
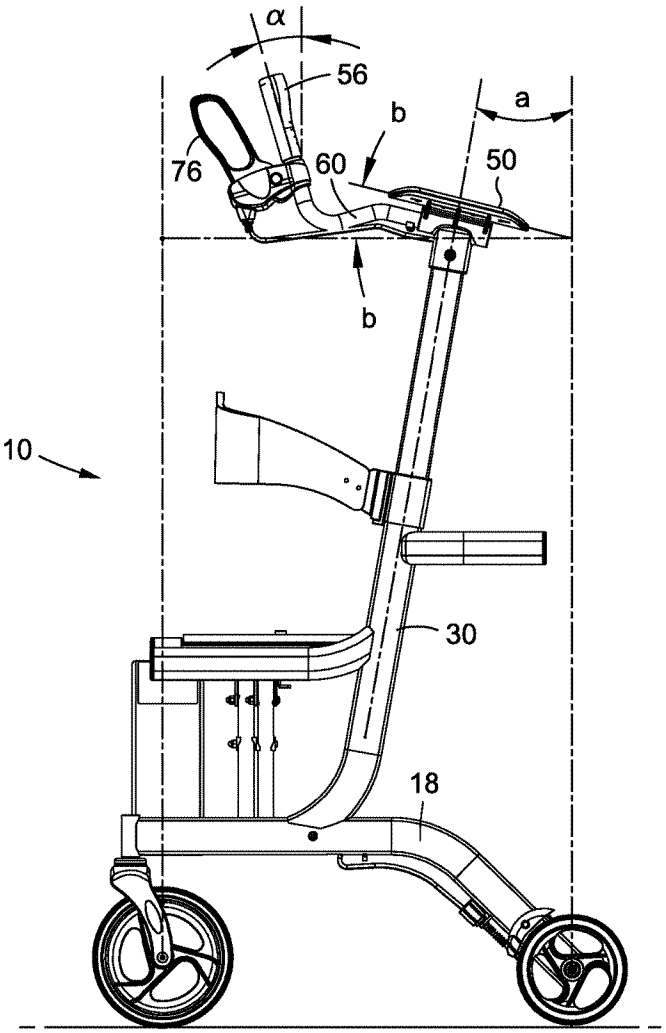
FIG. 18 is a side view of the disclosed wheeled walker device showing various angles of elements of the device.
Figure 22:
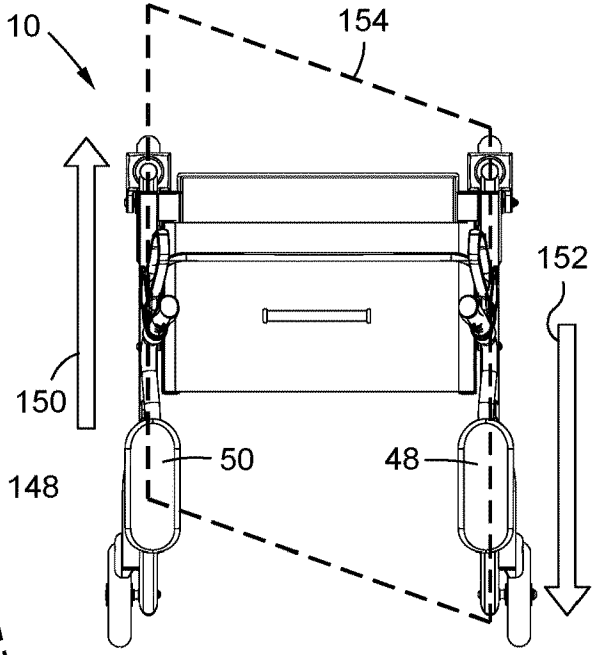
FIG. 22 is a top view of the wheeled walker with arrows showing opposing rearward and forward load forces.
Figure 21:
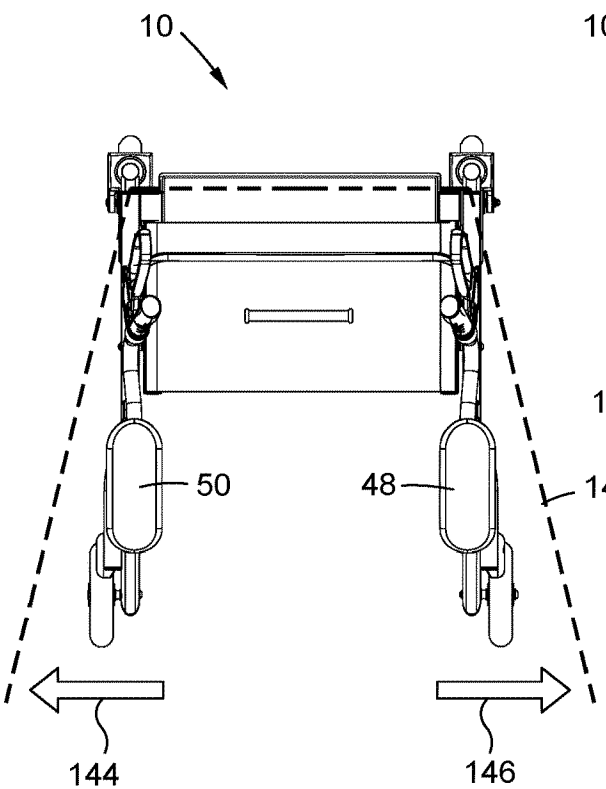
FIG. 21 is a top view of the wheeled walker with arrows showing opposing outward load forces.
Figure 20:
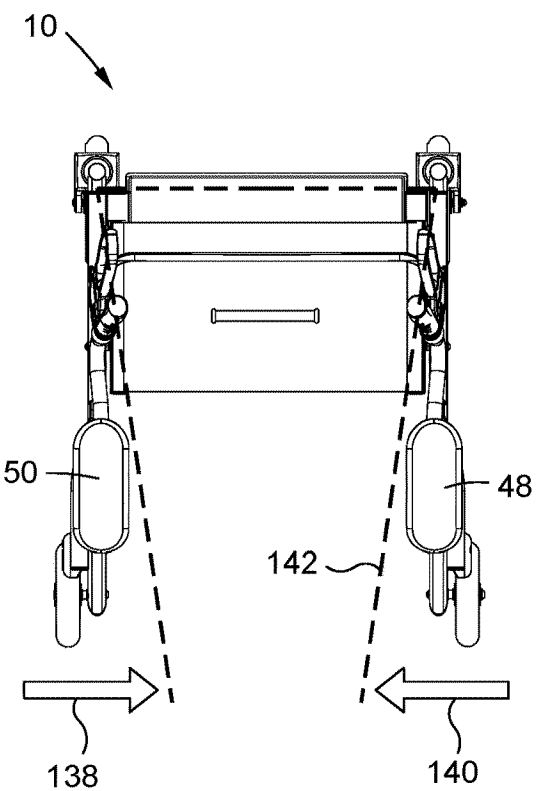
FIG. 20 is a top view of the wheeled walker with arrows showing opposing inward load forces.

Referring particularly to FIG. 18, there is shown a side view of the walker device 10. The FIG. 18 shows the left side of the device 10, however the angles discussed herein are identical for the mirror images of the right side. Strut 30 extends upwardly from base member 18 at an angel "a" of approximately 10 degrees, rearwardly from vertical. As such, the forearm support member 50 tilts backwards toward the user at about 14 degrees from parallel to the walking surface (the angle between b-b), or the horizonal portion of the base member 18. The angle shown is 14 degrees, however, it is contemplated that an angle from 10 degrees to 15 degrees may be suitable. The handle 56 is positioned forward approximately 16.4 degrees $\alpha$ forward from vertical. Referring to FIG. 19, there is shown a rear view of the device 10 showing handles 54 and 56 which are angled inwardly for the comfort of the user. The handles 54 and 56 are angled inwardly at approximately 8.8 degrees $\beta$ toward the center of the device 10, as shown in FIG. 19. Referring particularly to FIG. 19, there is shown a rear view of the device 10, with an example of how a shear forces may act upon an open deployed device 10, with arrows 132 and 134 representing opposing loads, which if the device 10 lacked structural stability of structures disclosed herein, could be temporarily deformed as demonstrated by broken lines 136 (shown exaggerated). The structures shown in FIGS. 10-16 (and oppositely positioned structures), which include the brackets 100 and 102 with the member 108 nested in the brackets 100 and 102 engaging the protrusions 124 of the brackets 100 and 102 increase torsional strength and shear stiffness to reduce temporary frame distortion of the walker device 10 in the open deployed position. Latches 111 and 112 also provide additional support. Likewise, the same structures resist opposed forces as shown in FIG. 20. Opposing loads 138 and 140 push inwardly upon the device 10, and without proper support of the structures disclosed herein could be temporarily deformed as demonstrated by broken lines 142 (shown exaggerated) pushing the supports 48 and 50 to close upon or interfere with a user. Likewise, FIG. 21 shows opposed forces 144 and 146 and without proper support of the structures disclosed herein could be temporarily deformed as demonstrated by broken lines 148 (shown exaggerated) pushing supports 48 and 50 outwardly away from the user. FIG. 22 shows opposed forces 150 and 152, as an example, acting forward and back, and without proper support of the structures disclosed herein could be temporarily deformed as demonstrated by broken lines 154 (shown exaggerated).

While the disclosed embodiments show the device 10 with four wheel assemblies, with adjustments to the elements and components the device 10, it is contemplated that the device 10 may be embodied with three wheels or three wheel assemblies, by using a single front wheel assembly, or with five or more wheels, by adding a central front wheel as-assembly, for example, without affecting the other advantages and features described herein.

The above description is given by way of example, and not limitation. Given the above disclosure, one skilled in the art could devise variations that are within the scope and spirit of the disclosure herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A collapsible wheeled walker device comprising:

a first side frame and a second side frame, each of the side frames comprising:

an inner side and an opposed outer side;

a plurality of wheel assemblies;

an elongate base member coupled to the plurality of wheel assemblies;

a strut member coupled to and extending upwardly from said base member; and a bracket support member coupled to and extending from said strut member;

at least two brackets positioned on the bracket support member, each bracket having a support surface and at least one protrusion extending from the support surface; and an X-folder apparatus interconnecting the first and second side frames, with the inner side of the first frame facing the inner side of the second frame, said X-folder apparatus comprising:

a first elongate support member and a second elongate support member, each of which having an aperture;

a first cross member having first and second ends, the first end of the first cross member pivotally connected to the base member of the first side frame, the second end of the first cross member coupled to the first elongate support member;

a second cross member having first and second ends, the first end of the second cross member pivotally connected the base member of the second side frame, the second end of the second cross member coupled to the second elongate support member; and wherein in a deployed position, the first and second elongate support members are received on the support brackets of respective ones of the bracket support members of the first and second frames, and the protrusions of the support brackets are received in the respective apertures of the elongate support members of the first and second cross members.

2. The device of claim 1 wherein said first and second cross members are rotatably coupled to each other between respective first and second ends of the first and second cross members.

3. The device of claim 1 wherein the elongate support members of the first and second cross members are positioned generally perpendicular to the first and second cross members.

4. The device of claim 1 wherein said strut members of the first and second side frames adjustably couple to two support members.

5. The device of claim 4 wherein said support members are forearm supports.

6. The device of claim 5 wherein the forearm supports are forearm gutters.

7. The device of claim 1, further comprising a seat having a rear edge positionable in front of rear edges of the struts.

8. The device of claim 1, wherein the seat is coupled to the first and second elongate support members.

9. A collapsible wheeled walker device comprising:

a first side frame having an inner and an opposed outer side, said first side frame comprising:

an elongate base member;

a strut member coupled to and extending upwardly from said base member;

a bracket support member coupled to and extending from said strut member;

at least two brackets coupled to the bracket support member, each bracket having a support surface and including at least one protrusion extending from the support surface;

a second side frame having an inner and an opposed outer side, said second side frame comprising;

an elongate base member;

a strut member coupled to and extending upwardly from said base member;

a bracket support member coupled to and extending from said strut member;

at least two brackets coupled to the bracket support member, said brackets having a support surface and including at least one protrusion extending from the support surface; and an X-folder apparatus interconnecting the first and second side frames, said X-folder apparatus comprising:

a first elongate support member and a second elongate support members, each elongate support member having an aperture;

a first cross member having a first and second ends, the first end of the first cross member pivotally connected to the base member of the first side frame, the second end of the first cross member coupled to the first elongate support member;

a second cross member having first and second ends, the first end of the second cross member pivotally connected the base member of the second side frame, the second end of the second cross member coupled to the second elongate support member; and wherein in a deployed position, the first and second elongate support members are received on the support surfaces of respective ones of the support brackets of the first and second frames, and the protrusions of the support brackets are received in the respective apertures of the elongate support members of the first and second cross members.

10. The device of claim 9 wherein said first and second cross members are rotatably coupled to each other between respective first and second ends of the first and second cross members.

11. The device of claim 9 wherein the first elongate support members is positioned generally perpendicular to the first cross member and the second elongate support member is positioned generally perpendicular to the second cross member.

12. The device of claim 9 wherein said strut members of the first and second side frames are adjustably couple to two support members.

13. The device of claim 12 wherein said support members are forearm supports.

14. The device of claim 13 wherein the forearm supports are forearm gutters.

15. The device of claim 9, further comprising a seat having a rear edge positionable in front of rear edges of the struts.

16. The device of claim 15, wherein the seat is coupled to the first and second elongate support members.

17. A collapsible wheeled walker device comprising:

a first side frame and a second side frame, each of the side frames comprising:

an elongate base member coupled to the plurality of wheel assemblies;

a strut member coupled to and extending upwardly from said base member; and a bracket support member coupled to and extending from said strut member;

at least two brackets positioned on the bracket support member; and an X-folder apparatus interconnecting the first and second side frames, said X-folder apparatus comprising:

a first elongate support member and a second elongate support member;

a first cross member having first and second ends, the first end of the first cross member pivotally connected to the base member of the first side frame, the second end of the first cross member coupled to the first elongate support member;

a second cross member having first and second ends, the first end of the second cross member pivotally connected the base member of the second side frame, the second end of the second cross member coupled to the second elongate support member; and wherein in a deployed position, the first and second elongate support members are received on the support brackets of respective ones of the bracket support members of the first and second frames, the first and second elongate support members and the support brackets having cooperating engagement elements that become engaged with each other when in the deployed position.

18. The device of claim 17, wherein the cooperating engagements include a protrusion on each bracket and apertures on the first and second elongate support members.

19. The device of claim 17, further comprising a seat having a rear edge positionable in front of rear edges of the struts.

20. The device of claim 17, wherein each side frame includes a handle extending from the strut.

* * * * *